United States Patent [19]

Bratovz

[11] Patent Number: 4,955,537

[45] Date of Patent: Sep. 11, 1990

[54] MODEL RAILROAD TRACK HAVING A TRACK BED

[75] Inventor: Matjaz Bratovz, Salzburg, Austria

[73] Assignee: Elfriede Rössler, Salzburg, Austria

[21] Appl. No.: 303,462

[22] Filed: Jan. 30, 1989

[30] Foreign Application Priority Data

Dec. 5, 1988 [DE] Fed. Rep. of Germany ..... 3840952

[51] Int. Cl.[5] ..... E01B 23/00

[52] U.S. Cl. ..... 238/10 B; 238/10 E

[58] Field of Search ..... 238/10 R, 10 A, 10 E, 238/10 F, 10 B, 10 C; 104/DIG. 1; 105/1.5

[56] References Cited

U.S. PATENT DOCUMENTS

| | | | |
|---|---|---|---|
| 3,650,468 | 3/1972 | Ewe et al. | 238/10 E |
| 4,150,789 | 4/1979 | Tong | 238/10 E |
| 4,219,153 | 8/1980 | Cheng | 238/10 E |

FOREIGN PATENT DOCUMENTS

| | | | |
|---|---|---|---|
| 0930194 | 6/1955 | Fed. Rep. of Germany | 238/10 B |
| 1801762 | 6/1969 | Fed. Rep. of Germany | 238/10 E |
| 1094484 | 5/1955 | France | 238/10 B |
| 1325754 | 3/1963 | France | 238/10 B |
| 0320787 | 5/1957 | Switzerland | 238/10 E |
| 0180580 | 6/1922 | United Kingdom | 403/331 |
| 2057898 | 4/1981 | United Kingdom | 238/10 F |

*Primary Examiner*—Andres Kashnikow
*Assistant Examiner*—Mark T. Le
*Attorney, Agent, or Firm*—Dilworth & Barrese

[57] ABSTRACT

A track for model railroads comprises a track bed (11), which simulates, e.g., a superstructure which is provided with a ballast bed. The track bed consists of a bar-shaped bed section (11), which is made of elastically and/or plastically deformable and preferably elastoplastic material and has a cross-sectional profile which simulates that of a typical superstructure and preferably has the configuration of an isosceles trapezoid without the closing longer side thereof. The side of the profile represents the road surface for receiving the track grate (1, 9, 10), the legs (13, 14) constitute slopes. The top surface of the bed section (11) is provided with recesses (15), which are substantially complementary to the track grate (1) so that the latter can be inserted into said recesses to a depth corresponding to at least part of the height of the sleepers or ties. The bed section is provided with stiffeners (17, 18) on its underside.

23 Claims, 6 Drawing Sheets

MODEL RAILROAD TRACK HAVING A TRACK BED

BACKGROUND OF THE INVENTION

1. Field of the Invention

This invention relates to a model railroad track having a track bed which simulates, e.g., a superstructure which is provided with a ballast bed.

2. Description of the Prior Art

Track sections for model railroads usually comprise an integral grate made of injection-molded plastic in a shape which corresponds to a track grate. The rails are connected to the sleepers or ties by extensions, which are integral with the sleepers or ties and have the shape of rail clips with nails, and the rails cover the webs which interconnect the sleepers or ties of the grate. The rails are provided at their ends with coupling elements, which can be interfitted so as to interconnect the tract grate sections. In that case the track sections consisting of straight and curved track sections and of switches or points and crossings can be assembled to form the desired track systems, which are usually secured to a plate in order to avoid an undesired shifting.

In an effort to comply with the desire of model railroaders for permanent ways which are as lifelike as possible, the manufacturers have developed tracks which are of the kind described first hereinbefore. But in the known tracks the track grates are usually firmly and permanently connected to the track bed which simulates the superstructure so that track sections provided with a track bed are joined and laid just as track sections provided having no track bed. The known track sections provided with a track bed can be installed only in a prescribed manner into a track system so that alterations in the installation and modifications from a predetermined track layout are possible only with restrictions. Because the several track elements provided with a track bed can be used only as prescribed and do not permit alterations, suitable prefabricated track elements must be available when a variation of the layout or a subsequent alteration is desired. As a result, the model railroader is hampered when he desires to provide individual and modified track layouts unless a large number of different track elements with and without a track bed are at his disposal.

SUMMARY OF THE INVENTION

For this reason it is an object of the invention to provide a modular track bed system which permits a laying of conventional track elements, which are not provided with special bed sections, in the usual manner and a selective joining of such track elements to bed sections, which are adapted to the conventional tracks and track elements or can be adapted thereto and which bed sections can repeatedly be used also in track systems having different track layouts.

In a track of the kind described first hereinbefore that object is accomplished in that the track bed consists of a bar-shaped bed section, which is made of elastically and/or plastically deformable and preferably elastoplastic material and has a cross-sectional profile which simulates that of a typical superstructure and preferably has the configuration of an isosceles trapezoid without the closing longer side thereof, the top side of the profile represents the road surface for receiving the track grate, the legs constitute slopes, the top surface of the bed section is provided with recesses, which are substantially complementary to the track grate so that the latter can be inserted into said recesses to a depth corresponding to at least part of the height of the sleepers or ties, and the bed section is provided with stiffeners on its underside. The model railroader can lay conventional track elements with or without the bed sections in accordance with the invention. Each track element may have associated therewith a correspondingly profiled bed section, which has either been preformed by the manufacturer or is adapted to a given track element by the model railroader in that it is simply cut to the desired shape.

The stiffeners for stiffening the bed section may consist of ribs or bar-shapped elements which are intergrally joined to the body of the bed section. Each stiffener suitably consists of two parallel ribs, which are arranged in pairs on the underside of the top wall of the bed section adjacent to the ends of the transverse grooves which receive the sleepers or ties. At least one rib of each pair thereof is so high that its bottom edges are aligned in side elevation with the side edges of the bed section.

In accordance with a further feature of the invention the bed section is provided in its bottom surface with receptacles for receiving stiffeners made of a stiffer plastic or of metal.

The stiffeners suitably consist of a ladderlike member. The side bars of the ladderlike member are suitably provided on mutually opposite sides in regions between at least one rung in alternation with interrupting recesses which permit an adaptation to the bed sections in case of dimensional deviations and also permit the bed sections to be given a curved shape for use as a bed of curved track sections.

The spacing of the side bars of the ladderlike member suitably matches the distance between the longitudinally extending ribs provided on the underside of the profiled bed section so that the side bars can be held between the ribs.

Individual rungs which are spaced apart are suitably provided with bushings having bores which are aligned with bores in the top surface of the bed sections and with bores in the sleepers or ties of the track grate. Pins or nails may be inserted through such aligned bores and may be used to connect to a base plate the track grates which have been inserted into the bed sections.

The bushings are suitably secured in shell-like or two shell-like retaining elements, which are intergrally joined to the underside of the top wall of the bed section and which are concentric to the bores.

In accordance with a further feature of the invention the ladderlike profiled stiffening members are provided on one side of their side bars with pins, which have a predetermined spacing and extend through bores in the wall of the bed section and are non-positively held in bores of the track grate. Such plug joints permit a simple detachable connection between the track grates and the associated bed sections.

To ensure that the bed sections can be adapted to different track layouts in a simple manner, the bed sections are suitably provided on their underside with trim lines.

The trim lines suitably extend obliquely from the bottom edge of the legs to the ends of the bed sections and adjoin the outside surfaces of the mutually parallel stiffening ribs. Corresponding cutouts permit bed sections to be joined which extend at an acute angle to each other, such as is required, e.g., adjacent to switches or points.

Trim lines may also be provided which are parallel to the stiffening ribs and adjoin the outside surfaces thereof. At such trim lines the side parts of a bed section, for instance the slope-simulating side parts, can be removed from the central part of the bed section and may be reconnected to the central part by special profiled side part connecting members. In that case it will be possible to reuse bed sections which have improperly been cut and this will not result in a less attractive appearance.

The trim lines suitably consist of grooves, which constitute guides for scissors for cutting through corresponding linear portions of reduced thickness.

In accordance with a further feature of the invention the ends of the side bars of the ladderlike profiled members are provided with mutually complementary coupling elements, which can be coupled by being interfitted. Such coupling elements may then be used also to interconnect the bed sections in a simple manner.

The coupling elements may consist of forked elements having enlarged portions on the inside of their legs and of corresponding complementary arrowhead-shaped plugs. With that design the bed sections which are stiffenend by the ladderlike profiled members can be interconnected by snap-action joints.

For a further improvement of the modularity and variability, adapters provided with the coupling elements may be provided in different lengths and may be adapted to be joined by profiled coupling elements to the ends of the ladderlike profiled members. Such adapters may be inserted at switches or points or at curved sections or where required so that the bed sections can continuously be interconnected.

The bed section may comprise a central part for receiving the track grate and of side parts, which simulate the slopes and are adapted to be joined to the central part. To permit the central part to be connected to the side parts, the central part may be provided with parallel ribs, which are arranged in pairs, and the side parts may be provided with a approximately complementary riblike profile which is adapted to be slidably inserted between the ribs of the central part and/or to interlock therewith. Such ribs provided in pairs on the central part may be constituted by the above mentioned profiled stiffeners.

The length of each bed section suitably agrees to the length of a track grate section. Corresponding bed sections are provided for bifurcated track grates of switches or points. Alternatively, the bed section may be delivered in the form of long profiled strips, which can be cut to length by the model railroader. Alternatively, it is possible to deliver separate central parts and side parts which are adapted to be joined to the central parts and such central and side parts will then have to be cut to length.

In accordance with a further feature of the invention the ladderlike profiled stiffening members are provided with compartments for accommodating actuators for switch or point actuators which are controlled electrically and/or by hand.

This invention provides for model railroads a track system comprising a track grate consisting of rails and of sleepers or ties and a plastic bed formed with recesses for receiving the track grate also comprising coupling elements for making an electrically conductive coupling, which is connected to at least one end of each rail, wherein the bed comprises a central part that has a width which is at least approximately as large as a sleeper or tie length, also comprising at least one support, which has a top surface that is formed with the recess for receiving the track grate and on its bottom surface, which faces away from the top surface, is connected to the central part and consists of a compression-resisting material, and such support is provided at least adjacent to each location at which the track grate is secured, and the bed is made of an elastically deformable, flexible material, such as rubber or plastic, and is provided with coupling elements for providing a device for connection to side parts and/or to the support.

In its basic structure the track bed consists of a plastic bed section, which is preferably made of elastomeric or elastoplastic material and corresponds in cross-section to the superstructure of a permanent way and has the shape of a conventional ballast bed having lateral slopes. That bed section has a top surface or a top wall which between the side slopes has a profile that is complementary to the track grate that is held in said profiled section. The profiled bed section has such a configuration that it dows not possess an adequate stiffness. For this reason suitable profiled stiffeners are provided on the underside and preferably consist of the above-mentioned longitudinally extending ribs.

The bed sections may be obtained as separate items because they are compatible with the conventional track grates which the model railroader already possesses. Alternatively, a track system may be delivered in which the track grates have already been inserted into several profiled bed sections so that the first installation of the track system does not require trimming and fitting work to be performed by the model railroader.

Owing to their profiled underside the bed sections inherently have an adequate stiffness. But pressure applied to the track grate sections held in the profiled bed sections might result in an undesired deflection. For this reason a further feature resides in that the profiled bed sections are designed to receive on their underside a stiffening grid consisting, e.g., of ladderlike profiled members.

The length of each bed section will always have the same length as the track grate section that is held therein. For interconnecting the track grate sections and profiled bed sections, the track grate sections may be interconnected in the usual manner by coupling elements, which are provided at the ends of the track grate sections and which wull also hold the bed sections in position. But stronger connections may be desired and may be provided in that the bed sections are interconnected too. For that purpose the ladderlike profiled stiffeners are provided at their ends with coupling elements for making snap-action joints.

As has been mentioned hereinbefore, the bed sections may consist of central parts for carrying the track grate sections and of side parts, which are adapted to be connected to the central parts and simulate the slopes. When a curved track grate section is to be inserted into the central part, the latter can be bent in its plane without difficulty. When the side parts have been joined to the central part, the edges may bulge or be upset because the radii are increased or decreased. Such bulging will be avoided if the profiled side parts are connected to the central part so as to be longitudinally slidable relative thereto, as is contemplated in certain embodiments of the invention.

DETAILED DESCRIPTION OF THE PREFERRED EMBODIMENTS

Figure 1:
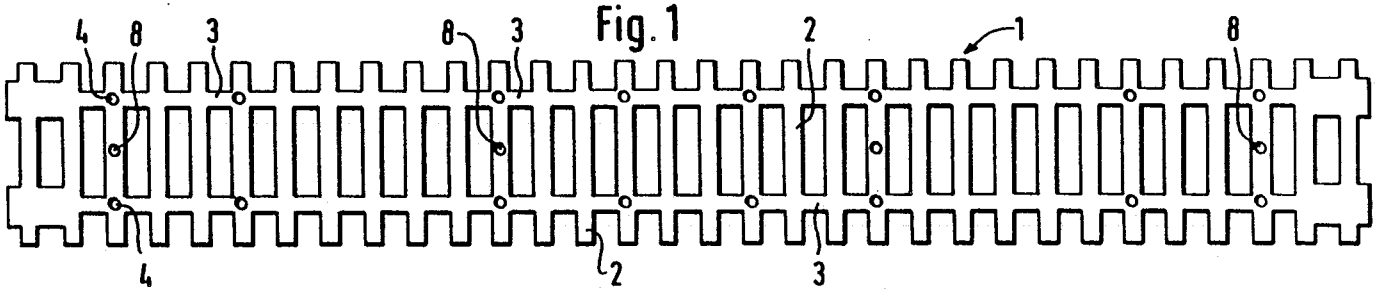
FIG. 1 is a bottom view showing a track grate.
Figure 2:
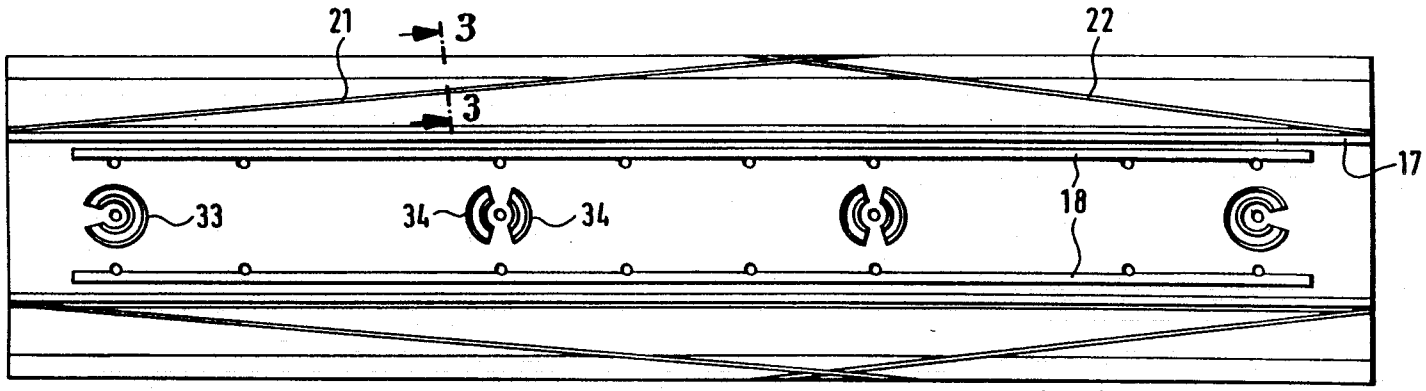
FIG. 2 is a bottom view showing a bed section.
Figure 3:
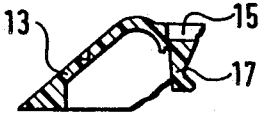
FIG. 3 is a sectional view taken on line 3—3 in FIG. 2 and shows the bed section.

Illustrative embodiments of the invention will now be explained more in detail with reference to the drawing.

The track grates inserted into the bed section are of usual type and as is apparent from FIG. 1 comprise an integral grate structure 1 that is made of plastic. The grate structure made of plastic injection molding consists of parallel sleepers or ties 2, which are joined by parallel connecting webs 3 disposed under the rails, which are to be connected to the grate structure 1. At the crossings between the connecting webs 3 and the sleepers or ties 2 the grate structure is provided with blind holes 4, which are regularly spaced apart and serve to make non-positive joints to the ladderlike stiffener 6 by means of pins 7, which have been forced into and are non-positively held in the stiffener 6. Individual sleepers or ties are provided in their central region with through holes 8, which are used in a manner to be explained hereinafter to connect the track grates inserted into the bed sections to the base plate by means of pins or nails.

Figure 4:
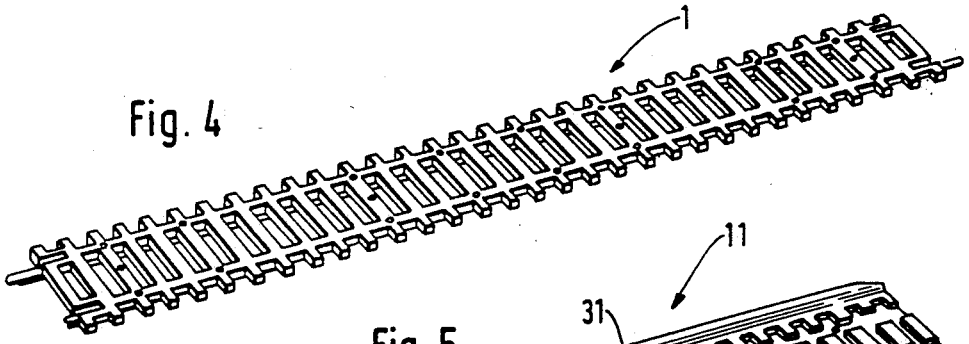
FIG. 4 is a perspective view showing the track grate viewed from below.
Figure 5:
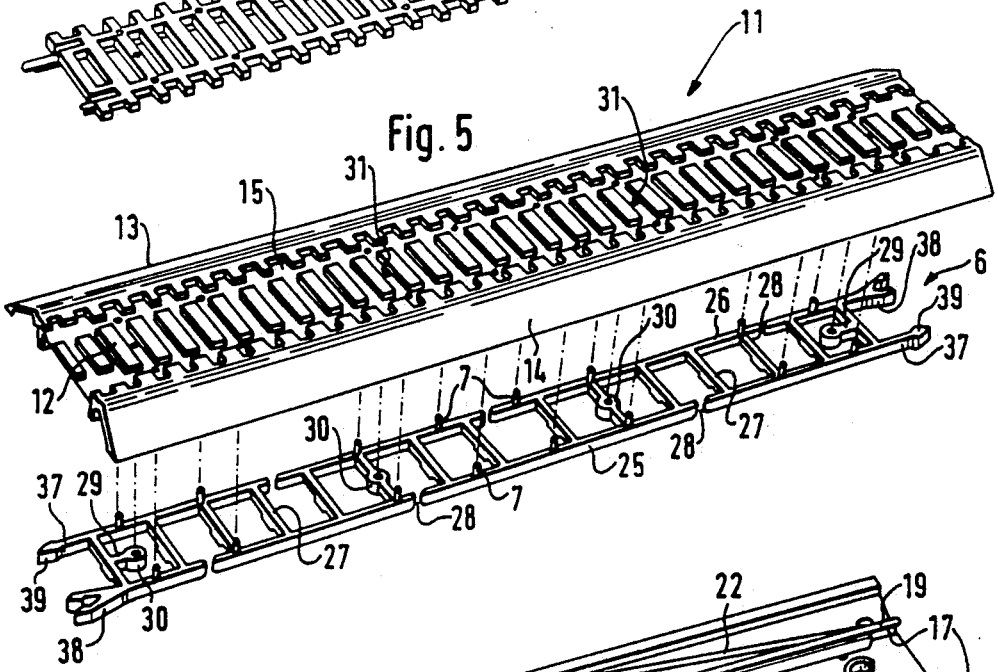
FIG. 5 is a perspective view on the top of the bed section of FIG. 2 and a ladderlike stiffener which can be connected thereto.
Figure 6:
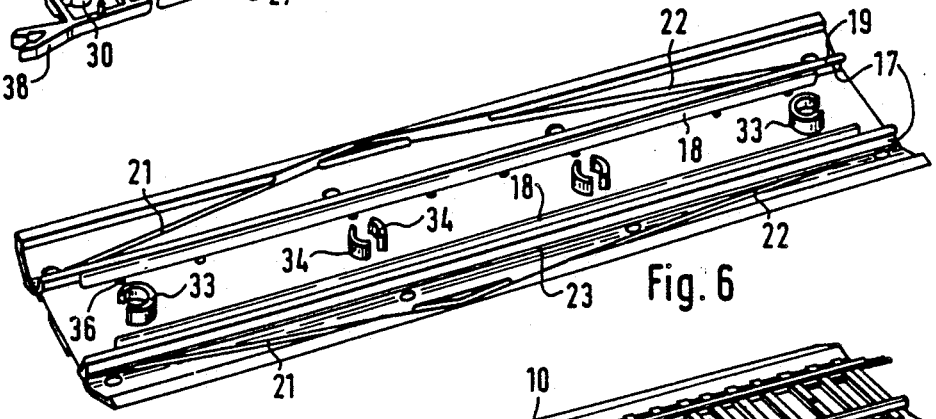
FIG. 6 is a perspective view showing the bed section viewed from below.
Figure 7:
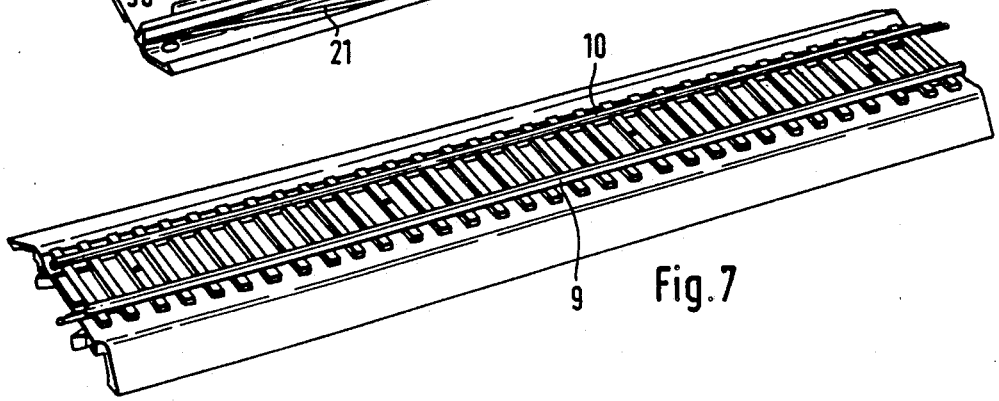
FIG. 7 shows a track grate which has been inserted into the bed section.

FIG. 4 is a perspective view showing the grate structure 1. The rails 9, 10 are so secured to the grate structure 1 that they cover the connecting webs 3 so that the latter are not visible from above. The track grate consisting of the grate structure 1 and the rails 9, 10 secured thereto is of known type and may be used in itself in the usual manner to provide track systems having any desired layouts.

The track grate is supported in the bed section 11, which consists of an injection molding of elastoplastic plastic and in its basic shape has approximately the profile of an isosceles trapezoid without the longer bottom side or base. The bed section comprises a central part 12, to which beveled side parts 13, 14 are integrally joined. In a first embodiment, side parts 13, 14 are integrally formed with the central part 12 at the longitudinal side edges of the latter and desirably also consist of an elastically deformable flexible material, preferably of rubber or plastic. The central part is formed in its top surface with a relief structure 15, which is complementary to the grate structure 1 so that the grate structure can be inserted into the recesses of the relief structure 15 in such a manner that the sleepers or ties 2 of the grate structure only slightly protrude above the recesses.

At each edge of the central part 12 the bed section 11 is provided on its underside with two parallel ribs 17, 18, which define between them a groove. The inner rib 18 of each pair thereof is higher than the outer rib 17. The outer ribs 17 are provided on the inside edge with inwardly directed bulges 19. The ribs 17, 18 which are provided in pairs at the edges of the central part 12 serve to stiffen the profiled part and serve also as coupling elements for coupling to side parts 20 unless the side parts 13, 14 are integral with the central part 12. The side parts 20 may be provided with coupling elements which are complementary to those of the central part 12 and are part of connecting means and may consist, e.g., of a groove having different widths in cross-section.

The coupling element provided on the central part 12 may be constituted by a longitudinal rib 17, 18, which protrudes from the underside and which preferably varies in thickness over its height.

The ribs 17, 18 may constitute supports which are integrally formed on the central part 12.

The bed section is provided on its underside with inclined trim lines 21, 22, which are constituted by grooves so that they are weakened lines. The trim lines extend from the outer edge of the side parts 13,14 to the ends of the bed sections 11 in the direction to the outside of the ribs 17. Additional trim lines 23 closely adjoin the ribs 17 on the outside. Because the trim 21, 22, 23 are constituted by grooves, they provide a good guidance for trimming scissors. The side parts 13, 14 can be trimmed along oblique lines if the bed sections 11 serve to support track grates which are connected to a switch or point. When the side parts 13, 14 have been severed from the central part 12 by cuts along the trim lines 23, the side parts 20 can be connected by complementary connecting profiled portions 24 to the central part 12 at the ribs 17, 18. In order to ensure the desired variability the side parts 13, 14 are provided on their underside with marks and/or weakened lines.

The bed sections 11 may be stiffened by ladderlike stiffeners 6 connected thereto. The stiffeners consist of plastic injection moldings made of a harder plastic. The side pieces 25, 26 of the ladderlike stiffeners 6 are interconnected by weblike rungs 27 and between one or more rungs 27 are interrupted by gaps 28 disposed in alternation on opposite sides. Owing to said gaps the profiled ladderlike stiffener 6 can be bent in its plane and for a compensation of dimensional deviations may be upset and stretched.

Bushings 30 are connected directly or by weblike extensions 29 to individual rungs and when the ladderlike member has been inserted into the bed section 11 are aligned with bores 31 of the bed section and with the bores 8 of the track grate. The track grates inserted into the bed section 11 may be secured to a base plate by nails or pins which have been inserted through the aligned bores 8, 31, 30.

The spacing of the side bars 25, 26 of the ladderlike stiffeners 6 matches the distance between the inner ribs 18 of the bed section 11 so that the ladderlike stiffener can be inserted between said inner ribs 18. Shell-like receptacles for centering and retaining are connected to the bottom surface of the top wall of the central part 12. Said receptacles comprise shell-like receptacles 33 having in their cylindrical shell a recess for receiving the bushings 30 and webs 29 for retaining them and two shell-like receptacles 34 for those bushings 30 which are centrally disposed in the rungs 27.

For a fixation of the track grate 1, 9, 10 which has been inserted into the relief structure 15 the longitudinal side bars 25, 26 are provided with the pins 7, which extend through the top wall of the central part 12 of the bed section 11 in bores 36 and are non-positively retained in the blind holes 4 of the grate 1.

The supports 6 for stiffening the bed sections are suitably ladderlike and at least near the fixing points for the track grate are provided with rungs. The side bars of said ladderlike supports are suitably interrupted.

Figure 10A:
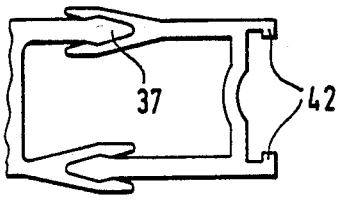
FIGS. 10*a* to 10*f* show coupling elements for intercoupling the ladderlike stiffeners.
Figure 10B:
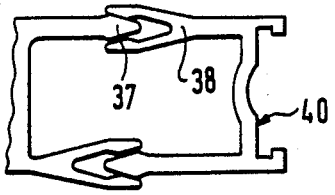
Figure 10C:
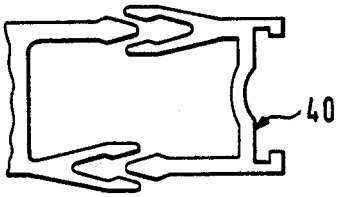
Figure 10D:
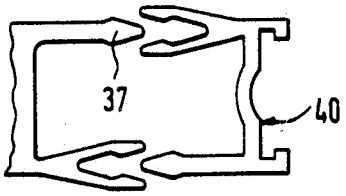
Figure 10E:
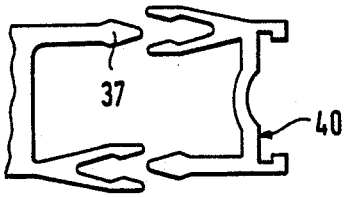
Figure 10F:
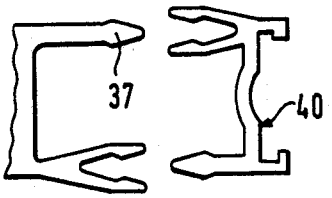
Figure 10F:
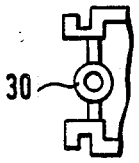
Figure 11:
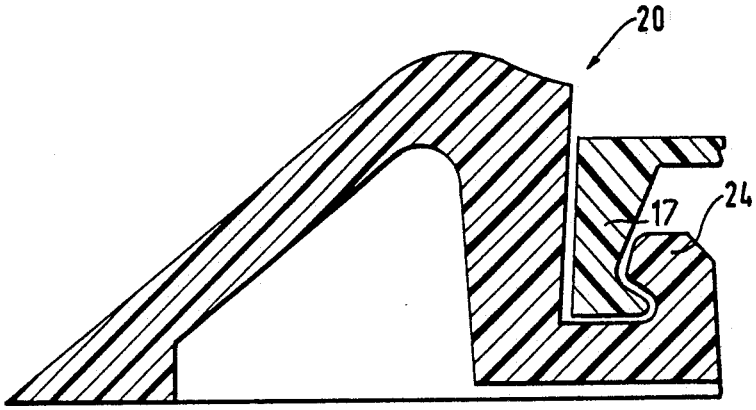
FIG. 11 is a transverse sectional view showing a profiled side part connected to the central part of the bed section.

The side bars of the ladderlike stiffeners or supports are provided at their ends with complementary coupling elements 37, 38, which constitute each one element of a coupling device, such as a snap-action coupling device. One element 38 of each coupling device is V-shaped or forked and is provided with enlarged portions at its confronting ends. THe mating coupling element 37 is similar to an arrowhead and as is best apparent from FIG. 10*a* has a configuration which is complementary to the inner portion of the coupling element 38.

The coupling device may be provided with locking pins, which extend along the side parts. The coupling devices may also be provided with guides for a lateral guidance and/or a guidance in height.

Figure 8:
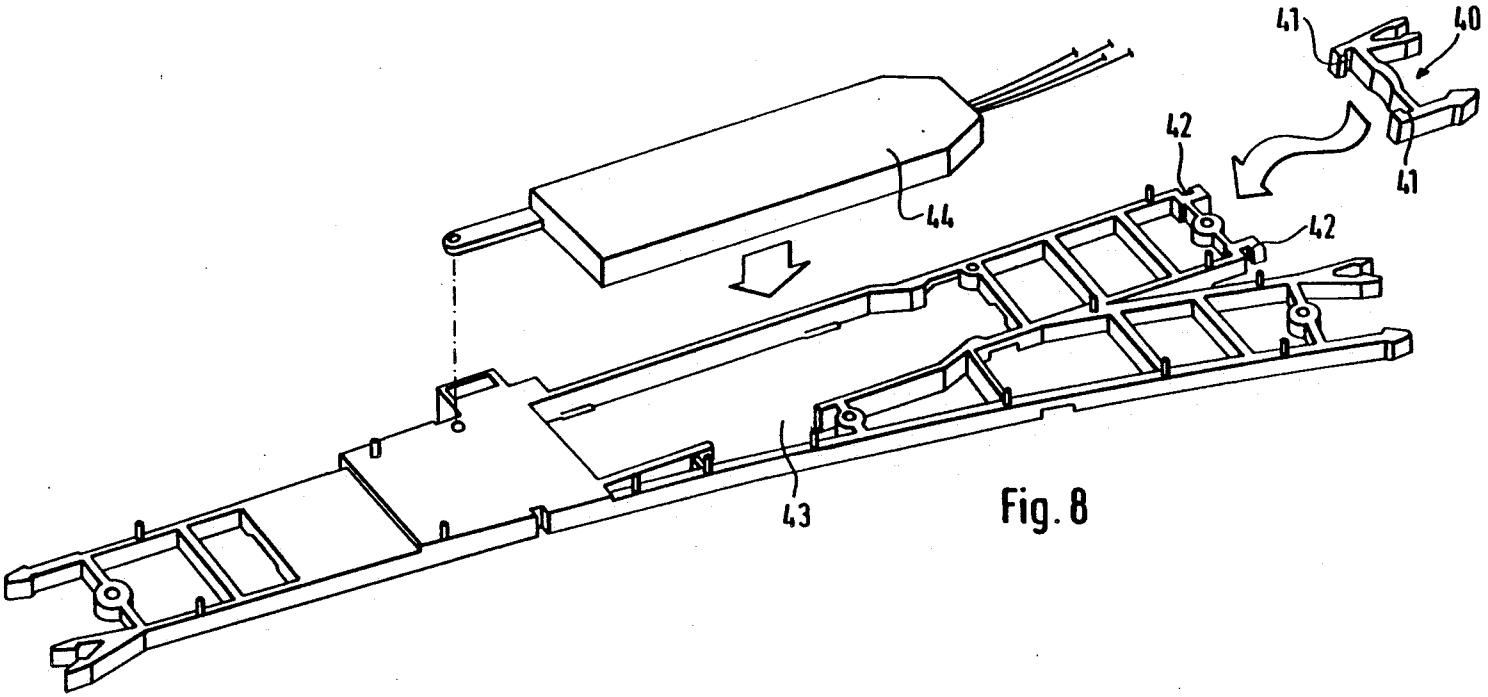
FIG. 8 show a ladderlike stiffener for a bed section for a point or switch, which stiffener is provided with a compartment for receiving an electric switch or point actuator and is provided at its end with an adapter that comprises end coupling elements.

In order to ensure the desired modularity of the system and to permit different track layouts to be provided, it is possible to provide adapters 40, which include the coupling elements 37, 38 and are shown in FIGS. 8 and 10.

FIG. 8 shows a ladderlike supporting stiffener for a switch or point bed section. The adapter 14 can be connected by complementary coupling elements 41, 42 to one end of the profiled support. The ladderlike profiled support is provided with a compartment-forming recess 43, which is adapted to receive an electric actuator 44 for a switch or point.

Figure 9:
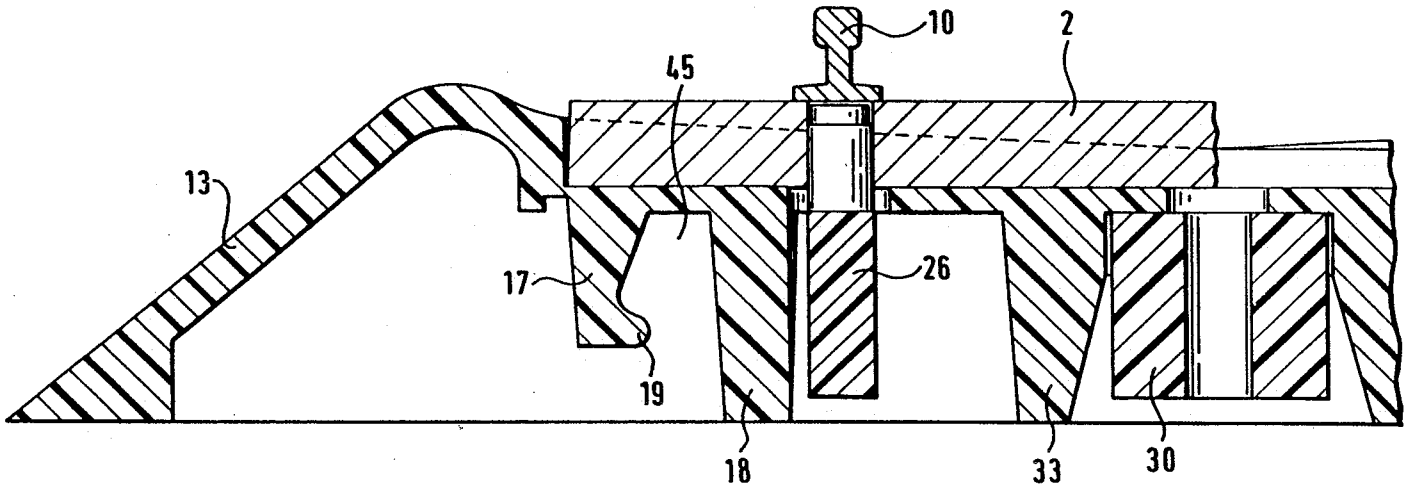
FIG. 9 is transverse sectional view showing a track grate which has been inserted into a bed section.

It is apparent from FIGS. 9 and 10 that the web 24 of the separate side part 20 is adapted to be slidably inserted or forced into the groove that is defined between the pair of longitudinally extending ribs 17, 18.

A continuous power supply line may be provided in the central part 12 and/or the support. The electric connector for the power supply line may be constituted by connector elements provided adjacent to the ends of the side bars.

Connecting elements may be provided which extend through the support between the track grate and a supporting surface for receiving the bed section.

The central part may be provided below the rails with recesses for receiving means for making contact between the rails and the power supply line. Sockets for receiving signal or overhead line masts may be integrated in the side parts.

I claim:

1. A model railroad system having a track bed which simulates a railroad superstucture of the type provided with a ballast bed, which comprises:

an elongated track bed section constructed of a deformable material, an elongated support member extending along each side of said bed section and inclined downwardly and away from said bed section to provide support therefor, said support members being substantially equal in length such that said track bed has substantially an isosceles trapezoidal cross-sectional configuration less the closing longer side, a plurality of recesses provided in the upper surface of said track bed section, a track grate having a plurality of tracks and ties configured, dimensioned and arranged to complement said plurality of recesses provided in said track bed section so as to be positionable thereon and inserted into said recesses a depth corresponding substantially to the thickness of the track ties, stiffener means having a ladder-like configuration and positioned on the bottom surface of said bed section, said stiffener means having a stiffness greater than the stiffness of said bed section, a plurality of receptacles provided on the bottom surface of said bed section for reception of at least portions of said stiffener means to facilitate attachment of said stiffener means to said bed section.

2. The model railroad system according to claim 1, wherein said stiffener means comprises bar-shaped elements joined to the body of said bed section.

3. The model railroad system according to claim 2, wherein said track bed section comprises at least two parallel ribs arranged in pairs of the under-side of said bed section adjacent to the ends of the recesses which receive said ties.

4. The model railroad system according to claim 1, wherein side bars of said ladderlike stiffener means are provided with interrupting gaps along mutually opposite sides of the stiffener means and in selected regions between rungs.

5. The model railroad system according to claim 4 wherein said interrupting gaps are provided in said selected regions which alternate with the gaps along the opposite sides of said stiffener means.

6. The model railroad system according to claim 1 wherein said bed section is provided with parallel ribs arranged in pairs, and said support members are provided with approximately complementary riblike parts adapted to be slidably inserted therebetween and to interlock with said parallel ribs.

7. The model railroad system according to claim 1 wherein said track bed comprises a central part for receiving said track grate and of side parts which simulate the slopes thereof and are adapted to be joined to said central part.

8. The model railroad system according to claim 1 wherein the spacing of side bars of said ladderlike stiffener means matches the distance between longitudinally extending ribs provided on the underside of said bed section.

9. the model railroad system according to claim 1 wherein said bed section is approximately equal in length to said track grate section.

10. The model railroad system according to claim 1 wherein said ladderlike stiffener means is provided on one side thereof with pins having a predetermined spacing and extendable through bores in said bed section and are non-positively held in correspondingly positioned and dimensioned bores of said track grate.

11. The model railroad system according to claim 1 wherein said track bed is provided on the underside with trim lines.

12. The model railroad system according to claim 11 wherein said trim lines extend obliquely from the bottom edge of said support members to the ends of said bed section and adjoin the outside surfaces of mutually parallel stiffening ribs formed on the under-side of said track bed section.

13. The model railroad system according to claim 11 wherein said trim lines adjoin on the outside of and parallel to stiffening ribs formed on the under-side of said bed section.

14. The model railroad system according to claim 11 wherein said trim lines comprise grooves.

15. The model railroad system according to claim 1, wherein the ends of side bars of said ladderlike stiffener means are provided with mutually complementary coupling elements having means to be coupled by being interfitted to each other.

16. The model railroad system according to claim 15 said coupling elements comprise forked elements having enlarged portions on the inside of their legs and corresponding complementary arrowhead-shaped lugs.

17. The model railroad system according to claim 15 wherein adapters are provided with said coupling elements, said adapters being provided in different lengths and adapted to be connected by profiled coupling elements to the ends of said ladderlike stiffener means.

18. The moedl railroad system according to claim 1, wherein individual rungs of said ladderlike stiffener means are spaced apart and are provided with bushings having bores which are aligned with bores correspondingly positioned in said bed section and with bores in said ties of said track grate.

19. The model railroad system according to claim 18, wherein said bushings are secured in at least one of shell-like and dual shell-like retaining elements integrally joined to the underside of said bed section and which are concentric to said bores.

20. The model railroad system according to claim 1 wherein said ladderlike stiffening means is provided with at least one portion defining a compartment for accommodating actuator means.

21. The model railroad system according to claim 1 wherein said ribs or bar-shaped elements are integrally joined to the body of said bed section.

22. The model railraod system having a track bed which simulates a railroad superstructure which comprises:

a track bed having a generally elongated bed section constructed of a deformable material, the bottom surface of said bed section being provided with means for reception of stiffening means, an elongated support member extending along each side of said bed section and inclined downwardly and away from said bed section to provide support for said bed section, a plurality of recesses provided in the top section of said bed section, a track grate having a plurality of tracks and ties configured and dimensioned to be positioned atop said track bed and inserted into said recesses a depth at least equal substantially to the thickness of said ties, stiffening means provided on the bottom surface of said bed section, said stiffening means having at least a pair of elongated members interconnected by generally transversely extending members and having a stiffness generally greater than the stiffness of said bed section.

23. A model railroad system having a track bed which simulates a railroad superstructure which comprises:

a track bed having a generally elongated bed section constructed of a deformable material, the bottom surface of said bed section being provided with means for reception of stiffening means, an elongated support member extending along each side of said bed section inclined downwardly and away from said bed section to provide support for said bed section, a plurality of recesses provided in the top section of said bed section, a track grate having a plurality of tracks and ties configured and dimensioned to be positioned atop said track bed and inserted into said recesses a depth at least equal substantially to the thickness of said ties, a ladderlike profiled stiffening member provided on the bottom surface of said bed section and having a stiffness greater than the stiffness of said bed section, said ladderlike stiffening member being provided with at least one portion defining a compartment for accommodating actuator means.

* * * * *